US009691597B2

(12) United States Patent
Hattan

(10) Patent No.: US 9,691,597 B2
(45) Date of Patent: Jun. 27, 2017

(54) ELECTRICALLY CONDUCTIVE AND FILTRATING SUBSTRATES FOR MASS SPECTROMETRY

(71) Applicant: Virgin Instruments Corporation, Marlborough, MA (US)

(72) Inventor: Stephen J. Hattan, Lowell, MA (US)

(73) Assignee: Virgin Instruments Corporation, Marlborough, MA (US)

( * ) Notice: Subject to any disclaimer, the term of this patent is extended or adjusted under 35 U.S.C. 154(b) by 0 days.

(21) Appl. No.: 15/056,223

(22) Filed: Feb. 29, 2016

(65) Prior Publication Data

US 2016/0260597 A1 Sep. 8, 2016

Related U.S. Application Data

(60) Provisional application No. 62/127,250, filed on Mar. 2, 2015.

(51) Int. Cl.
*H01J 49/02* (2006.01)
*H01J 49/04* (2006.01)

(52) U.S. Cl.
CPC ..... *H01J 49/0418* (2013.01)

(58) Field of Classification Search
CPC .. G01N 1/4044; G01N 1/405; G01N 33/6851; H01J 49/02; H01J 49/0409
USPC ..... 250/281, 282, 283, 286, 287, 288
See application file for complete search history.

(56) References Cited

U.S. PATENT DOCUMENTS 7,619,215 B2 * 11/2009 Kim ..... H01J 49/0418 250/288
8,294,089 B2 * 10/2012 Suzuki ..... H01J 49/025 250/281
8,748,889 B2 * 6/2014 Sasaki ..... H01L 29/78603 257/52
9,059,247 B2 * 6/2015 Yamazaki ..... H01L 21/76254
2010/0022416 A1 * 1/2010 Flemming ..... B01L 3/5085 506/39
2015/0299761 A1 * 10/2015 Hattan ..... G01N 1/405 435/23

* cited by examiner

*Primary Examiner* — David A Vanore
(74) *Attorney, Agent, or Firm* — Kurt Rauschenbach; Rauschenbach Patent Law Group, LLC

(57) ABSTRACT

A mass spectrometry substrate includes an electrically conductive material providing an electrical conductivity that allows at least one of a first and a second surface of the substrate to be maintained at a desirable potential for ion extraction while ions are desorbed during ionization. A solid lattice material comprises a plurality of pores positioned in a plurality of layers that form a network of at least one continuous channel extending from a first surface of the substrate to a second surface of the substrate. Each of the plurality of pores are dimensioned and positioned in the plurality of layers so that a first group of substances are adsorbed or absorbed on the first surface and a second group of substances are adsorbed or absorbed on the second surface.

22 Claims, 5 Drawing Sheets

ELECTRICALLY CONDUCTIVE AND FILTRATING SUBSTRATES FOR MASS SPECTROMETRY

CROSS-REFERENCE TO RELATED APPLICATION

The present application is a non-provisional application of U.S. Provisional Application Ser. No. 62/127,250, entitled "Electrically Conductive and Filtrating Substrates for Mass Spectrometry" filed on Mar. 2, 2015. The entire specification of U.S. Provisional Patent Application Ser. No. 62/127,250 is herein incorporated by reference.

The section headings used herein are for organizational purposes only and should not to be construed as limiting the subject matter described in the present application in any way.

INTRODUCTION

Studies of biological materials and the operations of biological systems are of interest to numerous scientific disciplines. Much investigation has focused on the appropriate means of procuring, processing, detecting and quantifying biological samples. These investigations are performed with the goal of gaining insight into the functions and manner by which the various components of complex biological systems operate under a given set of imposed or natural conditions. Critical to most studies of complex biological systems is a means of separating the various components in such a way as to make them more amenable to detection and quantification. Separation of the materials under study is often necessary due to the diverse numbers of different materials that are typically present in samples, the different physical and chemical characteristics of these various species, and the often large dynamic range in their relative concentrations. In many applications, some components of the material are present at much higher concentration levels than others being measured.

Separation stratagems of chromatography and gel electrophoresis are capable of being adapted to operate via different modes to take advantage of the different physical or chemical properties of proteins and peptides. Separation is accomplished by, for example, size, charge, and hydrophobicity, in order to achieve enough separation for analysis. The separation and/or concentration stratagem known as filtration is also widely used in the analytical and bioanalytical sciences. The process of filtration typically uses a solid lattice material to form a separation barrier against which different components of a sample may be parsed or separated as a function of one or more particular physical or chemical traits.

DESCRIPTION OF VARIOUS EMBODIMENTS

Figure 1:
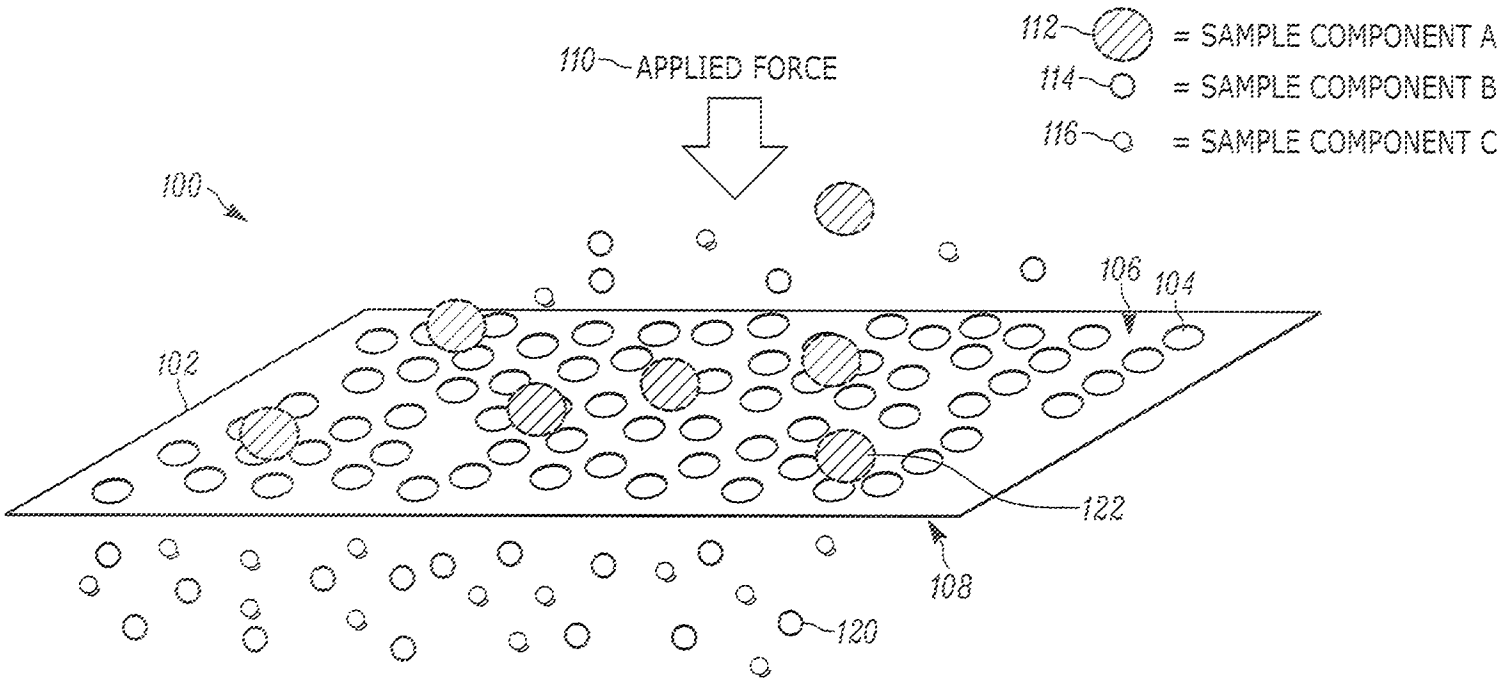
FIG. 1 illustrates a diagram of a filtration process that includes a substrate comprising a solid lattice material according to the present teaching.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teaching may be performed in any order and /or simultaneously as long as the teaching remains operable. Furthermore, it should be understood that the apparatus and methods of the present teaching can include any number or all of the described embodiments as long as the teaching remains operable.

The present teaching will now be described in more detail with reference to exemplary embodiments thereof as shown in the accompanying drawings. While the present teaching is described in conjunction with various embodiments and examples, it is not intended that the present teaching be limited to such embodiments. On the contrary, the present teaching encompasses various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

Mass spectrometry is a common technique used for molecular level analyses of compounds ranging in molecular weight from one to approximately 1,000,000 Daltons (Da) or atomic mass units (amu). Several different types of mass spectrometers are used in practice today. These mass spectrometers ionize compounds of interest into a gas phase state and then determine the mass-to-charge ratio of the ionized particles. The mass-to-charge measurement is used to determine the identity of a substance and/or to qualitatively distinguish that substance from other sample components. Mass spectrometers are generally classified by three characteristics, the type of sample ionization, the mechanism used for ion distinction, and the type of ion detection.

The ionization source of mass spectrometers should be capable of ionizing sample material in any state (i.e. solid, liquid or gas). One particular method of ionization is called "matrix assisted laser desorption ionization" (MALDI). Matrix assisted laser desorption ionization uses what is known in the art as a "matrix" substance to help promote the gas phase ionization of analytes. There are many commonly used MALDI matrices, but most of them can generally be classified as small molecule organic acids.

In MALDI mass spectrometry, a liquid solution containing the matrix or matrices is applied to the sample. If the sample is a solid material, the liquid solution containing the matrix is applied directly onto the surface of the material. If the sample is a liquid, the matrix and sample can be mixed together and allowed to dry before analysis. However, in various methods, the analysis can be performed in any sequential manner. After application of the matrix, the carrier solvent evaporates and the remaining matrix molecules form into solid crystals. The matrix crystals absorb energy from the laser desorption ionization source that causes thermal excitation and the rapid expansion into the gas phase. During the process of matrix excitation and gas phase expansion, species, compounds, and materials in contact with the matrix are also collaterally induced into the gas phase. The resulting comingled sample molecules are ionized. The generated ions are controlled by the mass spectrometer and then detected by an ion detector. The mass spectrometer then generates a mass spectrum of the detected ions.

Sample preparation schemes for mass spectrometry may use a filtration process. Filtration is a separation technique that is widely used in many fields, such as chemistry, chemical engineering, and biological science for a variety of different applications. Regardless of the application, the effectiveness of the filtration process relies on properties and features of the filter. The filter is a solid lattice material or substrate that contains pores or channels. These pores permeate the filter and, in order for affect a successful separation, must be of the proper size and dimension. Also, the physical and chemical composition of the filter or solid lattice that makes up a separation barrier must be compatible with the objectives of the filtering process. The filter must be robust enough to withstand the magnitude of forces that are applied to it during filtration without causing a physical failure of the filter structure, such as a rupture, tear, split or crack in the filter structure. Also, the chemical composition of the filter must be compatible with the particular application. For example, the material being filtered must not react with the filter material in a way that causes physical damage to the filter. Furthermore, the material being filtered must not decompose or otherwise breakdown the filter material.

Filters according to the present teaching may have any chemical composition (cellulose, plastic, metal, polymeric, glass or any combination thereof). Prototypes filters have been constructed from several commercially available products, such as Whatman™ Grade 3MM Chromatography Paper that is currently manufactured by GE Healthcare UK, Amersham Place, Little Chalfont, Buckinghamshire, UK, Immobilon® Transfer membranes that are currently available from Millipore Corporation, Billerica, Mass., and from Type A/C Glass Fiber Filter Sheets that are currently available from the Pall Corporation, Ann Arbor, Mich.

The term "filtration" as used herein is a type of separation that is commonly used to sort or parse different substances, compounds, or materials. The substances being separated by filtration may be of any physical state or phase or any combination of physical states or phases. Filtration is often accomplished using a solid but porous material that is sometimes referred to in the art as a membrane. The terms "membrane" and "filter" are both commonly used in the art to describe solid lattices that perform filtration for mass spectrometry.

One aspect of the present teaching is that the filter and membrane materials themselves can also be used as the sample plate in a mass spectrometer. In some embodiments, these filters or membranes comprise solid but porous materials that form separation barriers through which certain substances including compounds, particles or any types of materials pass in order to achieve separation. The solid but porous material can be a solid lattice material designed to serve as the separation barriers for filtration. These solid lattice materials include a plurality of pores in a plurality of layers having a distribution that enables them to separate and/or control the concentration of materials by filtration. The plurality of pores in a plurality of layers forms a network of at least one continuous channel from one surface of the substrate to a second surface of the substrate. Based on the physical and/or chemical characteristics of the particular filtration substrate, samples containing one or many substances may be filtered into different groups. Some materials may pass through the filter while others materials may become adsorbed and/or absorbed to the filtration substrate itself.

The inclusion of electrically conductive character into the solid lattice material used to affect the separation or concentration of materials by the process of filtration will also enable any and all materials adsorbed and/or absorbed to the surface of that substrate to be analyzed directly off of that same substrate by mass spectrometer. The commercially available materials described herein for constructing filters according to the present teaching, such as Whatman™ Grade 3MM Chromatography Paper, Immobilon® Transfer membranes, and Type A/C Glass Fiber Filter Sheets, can be treated in various ways according to the present teaching to render them electrically conductive. For example, these materials can be made electrically conductive by a variety of means that includes coating with electrically conduct inks or dyes, coating surfaces with electrically conductive metals, such as gold or copper, and coating surfaces with electrically conductive non-metal substances, such as graphite or carbon nano-tubules.

FIG. 1 illustrates a diagram of a filtration process 100 that includes a substrate 102 comprising a solid lattice material according to the present teaching. The solid lattice material comprising the substrate 102 forms a separation barrier that performs one or more filtering functions. In various embodiments according to the present teaching, the lattice materials can have one or many different types of chemical composition, such as cellulose, plastic, metal, polymeric, glass or any combination thereof. One skilled in the art will appreciate that the present teachings are not limited to any particular chemical composition of the solid lattice material.

The solid lattice materials can be formed in various ways. In one particular embodiment, the solid lattice material may comprise a single continuous substrate. In other embodiments, the solid lattice material may take the form of a woven or matted material comprising numerous individual pieces that have been chemically or mechanically joined together to form a continuous structure.

The substrate 102 shown in FIG. 1 comprises a solid lattice material containing intermittent pores 104 that perform filtering functions. A pore is defined herein as a void or other passage in the solid lattice that allows for a degree of discrimination between those substances being filtered based on the presence or absence of a particular physical or chemical characteristic(s) of the substance being filtered.

In various embodiments, the distribution of pores can have regular or irregular spacing. Furthermore, in various embodiments, the distribution of pores can have regular or irregular dimensions. FIG. 1 illustrates an embodiment of a substrate 102 according to the present teaching in which the pores 104 are substantially the same dimension, and the pores are distributed substantially uniformly across the solid lattice material 102. In some embodiments, the solid component of the filter contains intermittent pores. However, in many embodiments, regardless of the distribution and spacing of the pores 104 on the filter, the pores 104 form a continuous channel in at least one path from one surface of the filter, for example the top surface 106 of the solid lattice material 102 in FIG. 1, to another surface of the filter, for example the bottom surface 108 of the solid lattice material 102 in FIG. 1, so as to form at least one complete channel. In some embodiments, the pores 104 form a network of continuous channels from one surface of the filter to another surface of the filter.

The actual dimensions of the substrates according to the present teaching are chosen for the particular filter application and for the particular mass spectrometer being used to perform the analysis. The pores in the filter material, which in one embodiment of the present teaching is a solid lattice that makes up a separation barrier, are chosen to discriminate the passage of different substances, compounds, or materials through the filter. Filtering is accomplished by the substrate 102 when the pores 104 of the filter material are such that a group or collection of substances having different and relatively uniform sizes, conformations, or collection of features physically pass through the pores 104 of the filter and a different group, or subset of the group, does not have the collection of features necessary for them to pass through the pores of the filter. Generally, a directional force 110 is applied to the material being filtered to impose contact and interaction of the group of substances 112, 114, and 116 that are to undergo filtration with the filter or solid lattice 102 so that the pores 104 contained within the solid lattice may discriminate amongst the substances 112, 114, and 116 to affect a separation of these materials in a way that expedites the filtration process.

As a result of the differing abilities of substances 112, 114, and 116 to traverse the filter or solid lattice material 102, and in response to the applied force 110, substances that can be compounds, particles, or any type of materials that are able to pass through the pores of the filter effectively migrate from one end of the filter to the other. In general, the substances that make the migration through the filter are collective known as the "filtrate". Conversely, substances that can be compounds, particles, or any type of materials that are unable to pass through the filter due to some manner of physical and chemical exclusion, are retained within the confines of the filter or on the first surface of the filter where the initial contact with the substance occurred. These retained materials are collectively known as the "retentate".

Referring to FIG. 1, substances component B 114 and component C 116 have migrated from the top 106 of the substrate 102 to the bottom 108 of the substrate 102, through the solid lattice material comprising the substrate 102, to form a "filtrate" 120 comprising component B 114 and component C 116 concentrated proximate to the bottom 108 of the solid lattice material 102. Substance component A 112 was not able to pass through the pores 104 of the solid lattice material comprising the substrate 102, and so substance A 112 remains concentrated proximate to the top 106 of the substrate 102 and forms the "retentate" 122.

Retentate particles, which are the substances, compounds, particles or materials that do not pass-through the filter, may become adsorbed or absorbed on the input surface of the filter. The extent of the adsorption or absorption depends upon several system variables including the duration of the filtration process, the magnitude of the applied force, and the chemical composition of the filter itself. These adsorbed and/or absorbed substances, compounds, particles, or materials are prevented from passing from the first input surface of the filter to the second or output surface of the filter.

Generally, in order to judge the effectiveness or extent of a filtration procedure, the retentate and/or the filtrate is monitored for the presence of the analyte(s) of interest. In practice, representative signals generated by the mass spectrometer, which imply the presence or absence of the analyte (s) of interest, are monitored to gain insight into the presence of certain materials. Such monitoring is commonly used to forecast, determine, evaluate or rate the outcome of a procedure for various applications in the food science, biological analyses, and environmental science industries. For example, analytical procedures can be used to target the presence or absence of a signal that indicates a critical and distinctive characteristic of one or more substances in order to evaluate the correctness or health of the process.

In another aspect of the present teaching, the solid lattice is used for sieving or as a barrier for controlling sample concentration. In this aspect of the present teaching, sample concentration is controlled by selecting the pores of the filter material so that a desired portion or concentration of a group or collection of substances having different and relatively uniform sizes, conformations, or collection of features physically pass through the pores of the solid lattice and the remaining portion does not pass through the pores of the filter. Generally, a directional force is applied to the material being sieved in order to impose contact and interaction of the group of substances to be sieved with the filtering substrate or solid lattice barrier of separation in a way that expedites the filtration process.

Another aspect of the solid lattice structures or substrates used for performing filtration and sieving according to the present teaching is that they can be made to be electrically conductive so that they can be used as a sample plate in the mass spectrometer. The present teaching, at least in part, relates to a dual-use substrate that first performs the filter functions necessary for preparing samples by performing filtration and is also made conductive enough to be directly used as the sample plate or sample target for the mass spectrometer during mass spectrometry analysis.

Figure 2A:
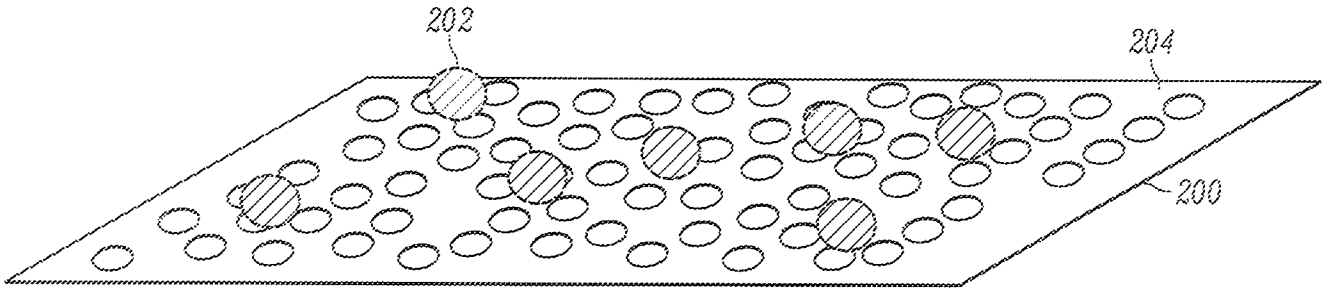
FIG. 2A illustrates a substrate according to the present teaching after performing filtration as described in connection with FIG. 1.
Figure 2B:
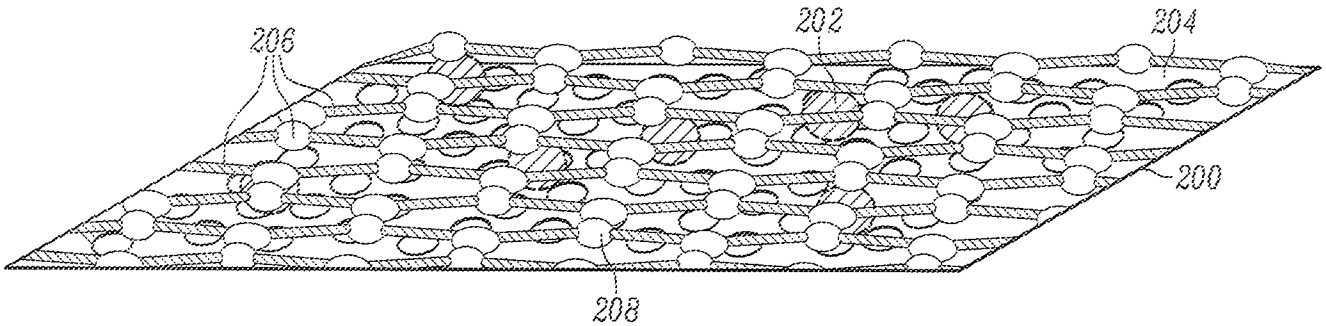
FIG. 2B illustrates a substrate according to the present teaching after removal from the filtration apparatus and coating with an appropriate MALDI matrix.
Figure 2C:
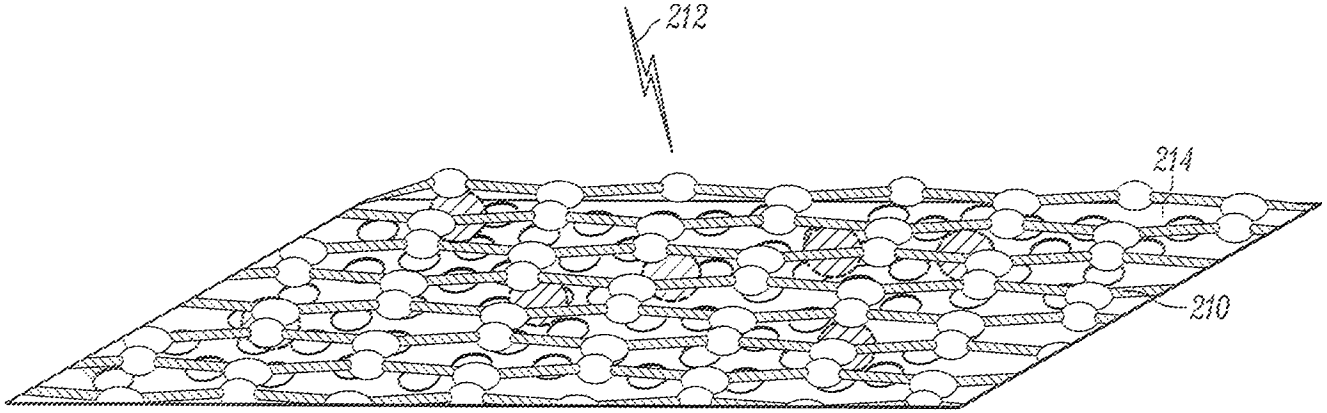
FIG. 2C illustrates the matrix-coated filter undergoing a mass spectrometer ionization event occurring from a laser beam impinging directly on the top surface of the matrix-coated substrate.

Thus, one advantage of the using filtering substrates of the present teaching is that mass spectrometry can be performed directly with the filtering substrate being used as the sample target subsequent to the filtering process. FIGS. 2A-2C illustrate a filtering method and apparatus of the present teaching that uses a substrate for filtering and/or for controlling the concentration of material to be analyzed in which the filter substrate is used as a sample target during mass spectrometry analysis.

FIG. 2A illustrates a substrate 200 according to the present teaching after performing filtration as described in connection with FIG. 1. The filtration process results in retentate component 202 adsorbed and/or absorbed onto the top surface 204 of the filter 200. The filter 200 is removed from a filtration apparatus and prepared for a subsequent mass spectrometer analysis.

FIG. 2B illustrates a substrate 200 according to the present teaching after removal from the filtration apparatus and coating with an appropriate MALDI matrix. The MALDI matrix coating 206 covers the top surface 204 of the substrate 200 and includes a matrix material 208 that assists in promoting gas phase ionization of the retentate component 202 to be analyzed using mass spectrometry.

Figure 2D:
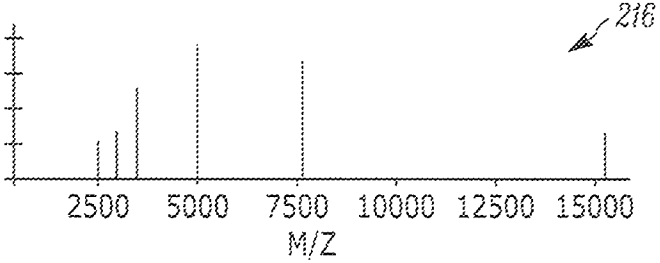
FIG. 2D illustrates a mass spectrometry data trace resulting from the mass spectrometer analysis performed after the ionization event shown in FIG. 2C.

FIG. 2C illustrates the matrix-coated filter 210 undergoing a mass spectrometer ionization event occurring from a laser beam 212 impinging directly on the top surface 214 of the matrix-coated substrate 200. FIG. 2D illustrates a mass spectrometry data trace 216 resulting from the mass spectrometer analysis performed after the ionization event shown in FIG. 2C.

Thus, substrates comprising a solid lattice material, according to one aspect of the present teaching, have dual utility. The solid lattice material is first used for filtering. During filtering, materials are adsorbed and absorbed to a surface of the substrate. After filtering, the substrate(s) are removed from the filter apparatus, applied with an appropriate ionization matrix material, if necessary, and then properly oriented into the mass spectrometer to present the materials that have been adsorbed and absorbed during filtration directly to the ionization source. These adsorbed and/or absorbed materials on the surface of the substrate 200 can then be analyzed directly in the mass spectrometer.

In one embodiment, the substrate material is a solid lattice material that is inherently electrically conductive. In another embodiment, the substrate material is not inherently conductive, but is made electrically conductive in some way, such as by incorporation or application of a electrically conductive material into or onto the substrate. One aspect of the present teaching is the understanding that solid lattice materials commonly used for filtration can be designed and constructed to be electrically conductive and otherwise suitable for use as a sample plate holder or target in a mass spectrometer. Another aspect of the present teaching is the understanding that solid lattice materials used for filtration can be designed and constructed so that they can be easily rendered electrically conductive by the inclusion of an electrically conductive material during fabrication or after fabrication of the solid lattice and that these substrates are otherwise suitable for use as a sample plate and accelerating electrode in a mass spectrometer. The dual use of such substrates is highly desirable for use in state-of-the-art mass spectrometer systems.

Electrically conductive substrates are advantageous because the substrates themselves can be used as an accelerating electrode in a mass spectrometer. An accelerating electric field can be applied directly to the substrate during operation of the mass spectrometer. The conductivity of the substrate material must, however, be sufficiently high to allow the entire substrate surface to be maintained at a potential that can be controlled by the mass spectrometer despite the fact that ions of a particular polarity (either positive or negative) will be desorbed from the substrate surface during ionization, such as with pulsed laser beam used in MALDI time-of-flight mass spectrometers. For example, in some mass spectrometer systems, the surface of the substrate presented to the ionization source has an electrical conductivity that is at least 0.0001 siemens per meter (S/m) or a resistivity that is less than 10,000 ohm-meter (Ωm).

In some embodiments according to the present teaching, the solid lattice material is selected so it is vacuum system and ionization source compatible. For example, the substrate lattice material can be selected so that it does not significantly outgas when pumped by a high vacuum pump. In addition, the substrate lattice material can be selected so that it does not outgas or otherwise decompose when exposed to ionizing radiation from a laser or other ionization source.

Figure 3:
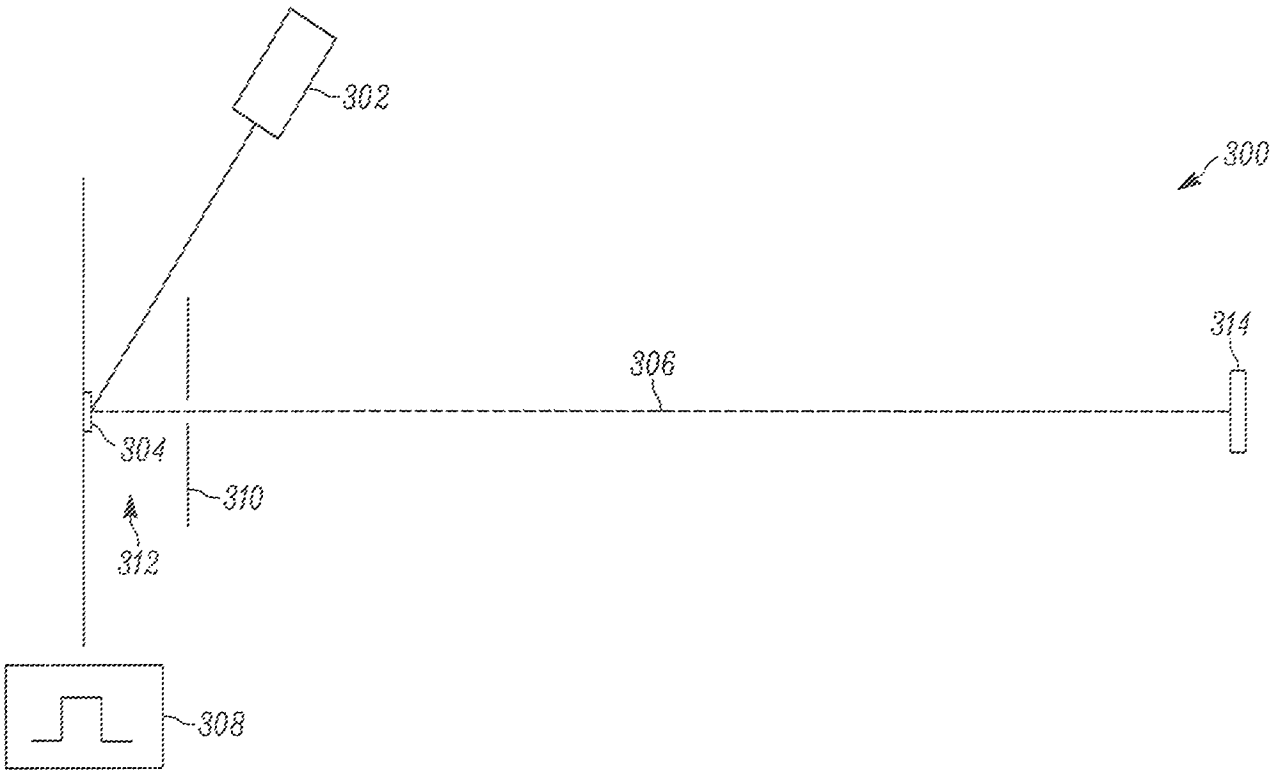
FIG. 3 illustrates a schematic block diagram of an embodiment of a MALDI time-of-flight mass spectrometer that includes a sample target comprising a substrate according to the present teaching.

FIG. 3 illustrates a schematic block diagram of an embodiment of a MALDI time-of-flight mass (TOF) spectrometer that includes a sample target comprising a substrate according to the present teaching. Time-of-flight mass spectrometers are well known in the art. The first practical TOF mass spectrometer was described by Wiley and McClaren more than 50 years ago. See, for example, "Time-of-Flight Mass Spectrometry: Instrumentation and Applications in Biological Research," Cotter R J., American Chemical Society, Washington, D.C. 1997, for review of the history, development, and applications of TOF mass spectrometers in biological research.

FIG. 3 illustrates a linear MALDI TOF mass analyzer 300, which means that the ion path is in one direction along a substantially co-linear path. In other embodiments, a TOF mass analyzer can have a non-linear ion path. By non-linear flight path, we mean a flight path that changes direction. For example, a TOF mass analyzer of the present invention can include an ion reflector (which is also called a reflectron or an ion mirror) along the ion path that changes the direction of the ions with one or more retarding electrostatic fields.

The linear TOF mass analyzer 300 includes a pulsed ion source 302 that generates a packet of ions from a sample plate 304 according to the present teaching that includes a substrate having solid lattice structures suitable for performing filter functions necessary to prepare samples for analysis and that is also conductive enough so that an electrical extraction pulse can be applied to the sample pate 304. In various embodiments according to the present teaching, the sample plate 304 filters biological samples that include a mixture of peptides produced by enzymatic digestion of proteins or filters an inorganic or organic chemical sample, or a mixture of organic and inorganic compounds. By packet of ions, we mean a group of ions that are generated by a single pulse of a pulsed ion source 302. The resulting generated packet of ions propagates along an ion path 306.

The pulsed ion source 302 can be a delayed extraction ion source that extracts the ions with an electrical pulse applied to the sample plate 304 by a pulse generator 308 after a predetermined time delay following an ionization event caused by an ion source, such as a laser. For example, the pulsed ion source 302 can be a delayed-extraction-laser desorption/ionization ion source where a pulsed laser is used to irradiate the sample plate 304 to be ionized with a pulsed laser beam. The laser beam generates a packet of ions during the laser pulse. An extraction grid 310 forms an ion acceleration region 312 for accelerating the packet of ions. A potential is applied to at least one of the sample plate 304 and the extraction grid 310 at a predetermined time after ionization to extract the packet of ions.

The ion path 306 is a field-free drift space that separates the ions in the packet of ions in time by their mass-to-charge ratio. A detector 314 is positioned at the end of the ion path 306 to receive ions in the ion packet. There are numerous operating modes for the linear TOF mass analyzer 300. The operating modes can be performed sequentially or they can be performed simultaneously in time. Performing more than one operating mode simultaneously allows the user to more quickly and efficiently detect different types of ions and, therefore, reduces the time it takes to analyze a sample or samples of interest.

EQUIVALENTS

While the Applicant's teaching are described in conjunction with various embodiments, it is not intended that the Applicant's teaching be limited to such embodiments. On the contrary, the Applicant's teaching encompass various alternatives, modifications, and equivalents, as will be appreciated by those of skill in the art, which may be made therein without departing from the spirit and scope of the teaching.

What is claimed is:

1. A mass spectrometry substrate comprising:

a) an electrically conductive material providing an electrical conductivity that allows at least one of a first and a second surface of the substrate to be maintained at a desirable potential for ion extraction while ions are desorbed during ionization; and b) a solid lattice material comprising a plurality of pores positioned in a plurality of layers that form a network of at least one continuous channel extending from a first surface of the substrate to a second surface of the substrate, each of the plurality of pores being dimensioned and positioned in the plurality of layers so that a first group of substances are adsorbed or absorbed on the first surface and a second group of substances are adsorbed or absorbed on the second surface.

2. The mass spectrometry substrate of claim 1 wherein the electrically conductive material is incorporated into the solid lattice material.

3. The mass spectrometry substrate of claim 1 wherein the mass spectrometry substrate is formed of the electrically conductive material.

4. The mass spectrometry substrate of claim 1 wherein the solid lattice material is electrically conductive.

5. The mass spectrometry substrate of claim 1 wherein the mass spectrometry substrate has an electrical conductivity that allows both the first and the second surface of the substrate to be maintained at a desirable potential for ion extraction while ions are desorbed during ionization.

6. The mass spectrometry substrate of claim 1 wherein the plurality of pores has a regular spacing.

7. The mass spectrometry substrate of claim 1 wherein the plurality of pores has an irregular spacing.

8. The mass spectrometry substrate of claim 1 wherein the dimension of the plurality of pores are generally uniform.

9. The mass spectrometry substrate of claim 1 wherein the dimensions of the plurality of pores are non-uniform.

10. The mass spectrometry substrate of claim 1 wherein the dimensions and position of the plurality of pores are such that the plurality of pores positioned in the plurality of layers form a barrier that controls a concentration of at least one of the first and the second groups of materials that is filtered by the plurality of pores to a predetermined concentration level.

11. A method of performing mass spectrometry, the method comprising:

a) providing a substrate comprising an electrically conductive material and a solid lattice material having a plurality of pores that is chosen to provide filtration of a sample material to be analyzed;

b) applying the sample material to be analyzed to a first surface of the substrate so that the sample material is filtered by the solid lattice material so that desired sample material passes to the second surface of the substrate;

c) positioning the substrate in a mass spectrometer so that one of the first and second surfaces of the substrate is presented to an ionization source in the mass spectrometer;

d) ionizing the desired sample material filtered by the solid lattice material;

e) controlling ions generated during ionization by applying an electrical pulse to the second surface of the substrate;

f) measuring a time-of-flight of ions reaching a detector in the mass spectrometer; and g) determining a mass spectrum of the ionized sample material from the measured time-of-flight of ions reaching the detector.

12. The method of claim 11 further comprising selecting a conductivity of the substrate so that at least one of the first and second surface of the substrate can be maintained at a desirable potential for ion extraction while ions are desorbed during ionization.

13. The method of claim 11 further comprising selecting a spacing of the plurality of pores in the solid lattice material to provide a desired filtration.

14. The method of claim 13 wherein the spacing of the plurality of pores is a regular spacing.

15. The method of claim 13 wherein the spacing of the plurality of pores is an irregular spacing.

16. The method of claim 11 further comprising selecting dimensions of at least some of the plurality of pores in the solid lattice material to provide a desired filtration.

17. The method of claim 16 wherein the selected dimensions of at least some of the plurality of pores are generally uniform.

18. The method of claim 16 wherein the selected dimensions of at least some of the plurality of pores are non-uniform.

19. The method of claim 11 further comprising selecting the solid lattice material to control a concentration of sample material.

20. The method of claim 11 wherein a chemical composition of the solid lattice material is chosen to provide a desired filtration.

21. The method of claim 11 wherein a chemical composition of the solid lattice material is chosen to substantially prevent outgassing when being pumped by a vacuum system.

22. The method of claim 11 wherein a chemical composition of the solid lattice material is chosen to withstand ionization without any substantial decomposition.

* * * * *